US005096624A

United States Patent [19]

Dörr et al.

[11] Patent Number: 5,096,624

[45] Date of Patent: Mar. 17, 1992

[54] PROCESS FOR THE TREATMENT OF RADIOACTIVE WASTE WATER

[75] Inventors: Aloys Dörr, Biblis; Uwe Kälberer, Frankfurt am Main; Klaus Rose, Leinach, all of Fed. Rep. of Germany

[73] Assignee: Noell GmbH, Würzburg, Fed. Rep. of Germany

[21] Appl. No.: 567,402

[22] Filed: Aug. 14, 1990

[30] Foreign Application Priority Data

Dec. 14, 1988 [DE] Fed. Rep. of Germany ..... 3842655

[51] Int. Cl.[5] ..... G21F 9/08

[52] U.S. Cl. ..... 252/631; 159/DIG. 12; 203/12; 203/38; 203/63; 203/DIG. 6

[58] Field of Search ..... 252/626, 631; 159/DIG. 12; 203/12, 38, 63, DIG. 6

[56] References Cited

U.S. PATENT DOCUMENTS

| | | | |
|---|---|---|---|
| 3,044,943 | 7/1962 | McCloskey et al. | 203/57 |
| 3,100,741 | 8/1963 | Rogillis | 203/63 |
| 3,214,347 | 10/1965 | Grebel et al. | 203/63 |
| 4,123,380 | 10/1978 | Norell | 252/628 |
| 4,430,257 | 2/1984 | Pope et al. | 252/629 |
| 4,434,074 | 2/1984 | Fox et al. | 252/628 |
| 4,440,680 | 4/1984 | Kitzes et al. | 252/632 |
| 4,500,449 | 2/1985 | Kuhnke et al. | 252/628 |
| 4,504,317 | 3/1985 | Smeltzer et al. | 106/90 |
| 4,540,512 | 9/1985 | Lahoda | 252/629 |
| 4,595,528 | 6/1986 | Greenhalgh | 252/629 |
| 4,800,042 | 1/1989 | Kurumada et al. | 252/628 |

FOREIGN PATENT DOCUMENTS 0125017 11/1984 European Pat. Off. .

*Primary Examiner*—Brooks H. Hunt
*Assistant Examiner*—Ngoclan Mai
*Attorney, Agent, or Firm*—Nils H. Ljungman & Associates

[57] ABSTRACT

A process for the treatment of waste water containing boron compounds and radionuclides. The waste water is essentially vaporized until dry to yield a concentrate. Boric acid ester and an azeotropic mixture of water and alcohol are produced in a reaction by the addition of an excess of a long chain primary alcohol, e.g. butyl alcohol, to the concentrate. The azeotropic mixture, excess alcohol and boric acid ester are then separated from the concentrate by distilling. The non-radioactive components are then separated from the concentrate leaving behind a radioactive residue, which can be safely disposed of. The azeotropic mixture is then separated back into water and alcohol, and the boric acid ester is saponified back into boric acid and alcohol. The alcohol and boric acid are recycled back into the treatment process and to the nuclear reactor.

19 Claims, 2 Drawing Sheets

PROCESS FOR THE TREATMENT OF RADIOACTIVE WASTE WATER

BACKGROUND OF THE INVENTION

1. Field of the Invention

This invention relates to a process for the treatment of waste water containing boron compounds and radionuclides.

Waste water of this type occurs, for example, as evaporator concentrate in nuclear power plants equipped with a pressurized water reactor.

For the disposal of radioactive material, it is necessary to achieve the greatest possible reduction of volume, since the storage space available is extremely limited. This is particularly true for radioactive waste water.

2. Description of the Prior Art

German Laid Open Patent Application No. 17 67 999 discloses a process for evaporating radioactive waste water, or chemically precipitating the radionuclides contained in the waste water.

For waste water which has a high concentration of boric acid, however, the evaporation does not achieve the desired success, since the remaining substances still contain large quantities of non-radioactive salts which are difficult to precipitate out. Major problems are also presented by complex-forming radioactive antimony (Sb-124) which has a half-life of approximately sixty days.

German Patent No. C-2723025 and "ABC-Chemie", Volume 1, 2nd Edition (Verlag Harry Deutsch, Frankfurt, 1970, page 198) each disclose a process to react boric acid and methanol with concentrated sulfuric acid as a catalyst to form boric acid trimethyl ester and water. After a separation, water is used to hydrolytically split the boric acid trimethyl ester into boric acid and methanol. This process was used to treat radioactive waste water from nuclear power plants containing boric acid and radioactive antimony. This process is unsatisfactory in several respects: Methanol, with air and ester, forms an explosive mixture which is flammable within broad limits. Methanol itself is highly volatile and toxic, and can therefore be permitted in the workplace in only very low concentrations. Furthermore, methanol and boric acid ester form an azeotropic mixture which is very complex, time-consuming and expensive to thermally separate. The sulfuric acid also represents a problem. Since all the radionuclides and the non-radioactive trace elements collect in the sulfuric acid, these substances must be removed from the sulfuric acid. Sulfuric/acid is also corrosive and expensive.

German Patent No. A-2252717 likewise shows the application of methanol for the esterification of boric acid in waste water.

European Patent No. A-0125017 discloses the usage of the alcohols methanol, propanol, isopropanol and mixtures thereof for reaction with boric acid to form boric acid esters. These alcohols also form an azeotrope with the boric acid ester, and these azeotropic mixtures are also difficult, time consuming and expensive to separate.

OBJECT OF THE INVENTION

Therefore, the object of the invention is a process for the treatment and disposal of waste water containing boric acid and other boron compounds and radionuclides, in particular radioactive antimony, in which the final, non-reusable components of the waste water can be reduced to a very small volume, and in which the process is as fast, non-polluting and economical as possible.

SUMMARY OF THE INVENTION

This invention is based on the knowledge that azeotropic mixtures of methanol and boric acid ester or ethanol and boric acid ester are difficult to separate, and must therefore be avoided whenever possible, while azeotropic mixtures of water and alcohols are easy to separate. In contrast to methanol, n-butanol does not require a sulfuric acid catalyst for esterification, and therefore, large quantities of contaminated salts can be avoided.

For this purpose, the invention proposes that essentially dry waste water be reacted with longer-chain primary alcohols, i.e. n-butanol rather than methanol, until there is complete esterification of the boric acid. The reaction alcohol-water azeotrope formed and the excess unreacted alcohol can then be distilled off, leaving the boric acid ester formed in the distillant. The azeotropic mixture of butanol and water has a boiling point of approximately 93° C., which can be lowered even further by distillation at a pressure lower than atmospheric pressure. If necessary, the waste water concentrate must be previously cooled to below the boiling point of the azeotropic mixture. After the remaining pure alcohol has also been distilled off at 117.5° C., the ester can likewise be distilled off by a further increase of the process temperature or a further decrease of the process pressure. Since the boiling point of butyl ester is 227° C., the temperature range between the boiling point of the alcohol and the boiling point of the ester is large enough to safely control the process. After the boric acid ester has also been distilled off, all the non-volatile components remain behind as solid products. Bonded into this solid residue are all the radionuclides and all the non-radioactive impurities of the concentrate. This solid residue is thus ready for final storage. As a result of this process, the intermediate storage of the residue is unnecessary, such as would otherwise be necessary to await the decay of the antimony activity, before the radionuclides could be chemically precipitated. This eliminates the need for giant intermediate storage facilities for the storage of evaporator concentrates, and also eliminates the need for the sulfuric acid catalyst in the esterification step. By means of the process according to the invention, evaporator concentrates and/or waste water can be processed either immediately or after a period of storage.

As with the prior art, the process according to the invention also offers the possibility of recycling the alcohol recovered during the saponification of the boric acid ester for re-use in treating additional waste water.

Moreover, the process according to the invention provide that the alcohol can be separated from the azeotropic mixture initially distilled off, and can therefore also be recycled for treating additional waste water. The boric acid is obtained substantially analytically pure from the saponification, and after separation from the water, can also be recycled without additional purification for use in the primary coolant of a nuclear reactor.

A very economical separation of the azeotropic mixture can be executed by a simple condensation of the azeotropic mixture followed by a subsequent separation of the two-phase mixture, e.g. in a decanter. The volume of the residues to be disposed of can be reduced even further by means of conventional chemical processes to first precipitate and then remove the non-radioactive salts from the radioactive contaminants.

Theoretically, the use of secondary or tertiary alcohols is also possible for the esterification of the boric acid, but additional catalysts would be required for the esterification to take place.

If necessary, the waste water can also be filtered before evaporation, and the solid substances obtained therefrom can be treated separately. When vaporizers employing an alkaline process are used, the concentrate must also be neutralized before the performance of the process according to the invention.

One aspect of the invention involves a process for the treatment of radioactive waste water which contains boron compounds and radionuclides, the treatment process comprising the steps of: the concentrating of the waste water to form a concentrate; maintaining the concentrate at a temperature below the boiling temperature of an azeotropic mixture of water and the alcohol which will be used for the esterification step: adding alcohol to the concentrate to form a mixture comprising water, alcohol, boric acid ester and residue containing non-radioactive components and radioactive contaminants; separating the boric acid ester from the mixture: and separating the non-radioactive components from the residue.

DESCRIPTION OF THE PREFERRED EMBODIMENTS

Figure 1:
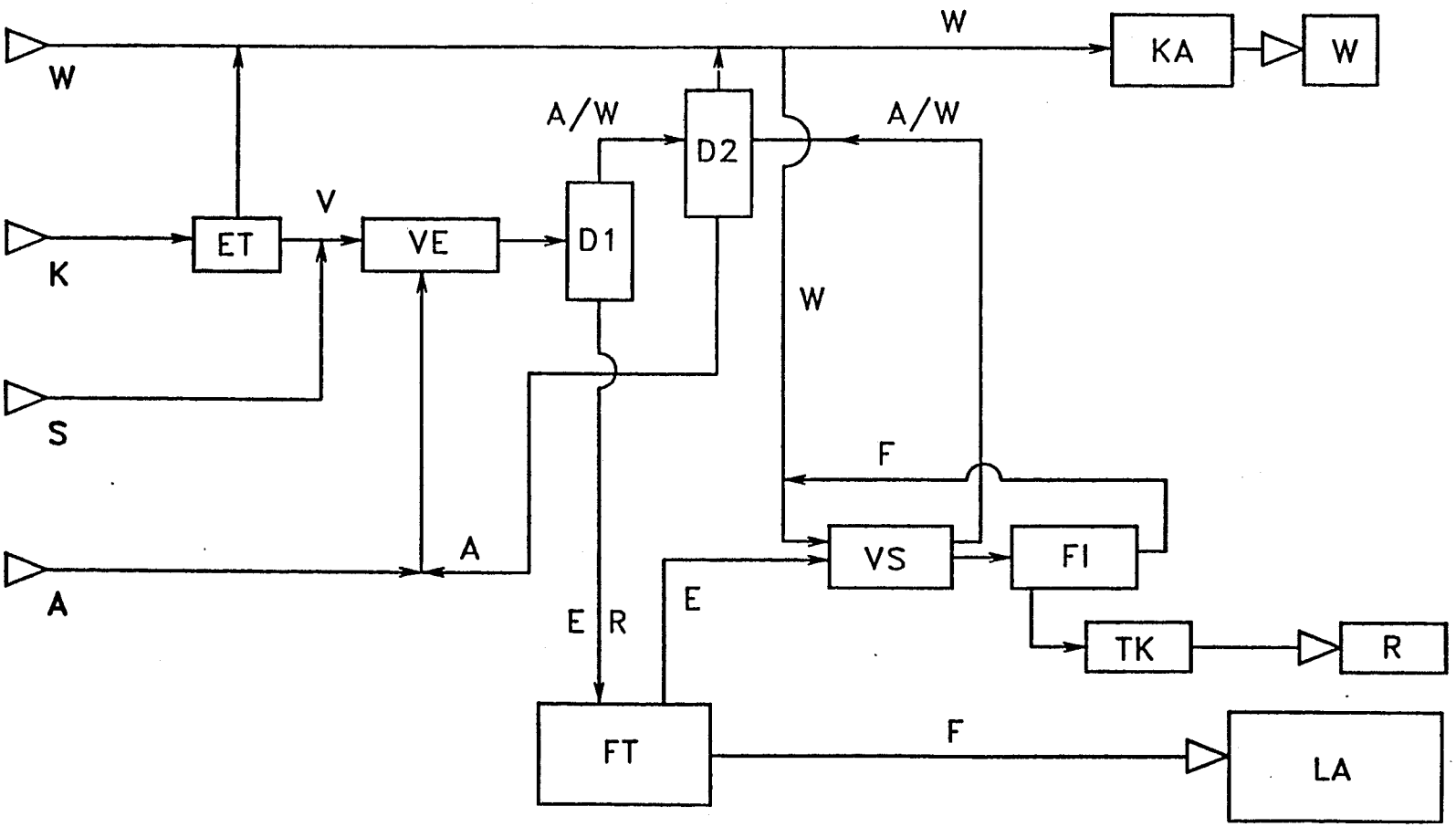
FIG. 1 is a schematic flowchart showing the theoretical sequence of the treatment process according to the invention.

As shown in FIG. 1, waste water or pre-concentrated waste water K is vaporized or dried in the first process stage ET. The concentrate V with other boric acids, borates and residues S from intermediate storage facilities or used materials, can then be subjected to an esterification VE by the slow addition of an excess of a long-chain primary alcohol e.g. butanol A. The esterification VE yields boric acid ester E. A first distillation stage D1 separates the azeotropic mixture butanol/water A/W from the ester and residues component ER. The ester and residues component ER is then conducted to an additional drying FT, which drying can take place, for example, directly in the final storage vessels, for the separation of the ester E from the remaining solid substances F. The solid substances F can be transported directly to a final storage facility LA, while the ester E is saponified with water VS. The analytically pure, crystalline boric acid R, is obtained by filtering FI the boric acid crystals R out of the filtrate portion F and oven drying TK the boric acid crystals R to remove any remaining liquids. The boric acid can then be returned to the power plant and the filtrate F is reusable for the saponification VS. The azeotropic mixture butanol/water A/W from the saponification VS and the distillation D1 is separated in a second distillation stage D2, and the components are, then, recycled. The resulting pure process water W is released for general disposal after a control analysis KA. Any residual water which is formed during the process and which may still possibly contain boron can be returned to the process for further purification.

Figure 2:
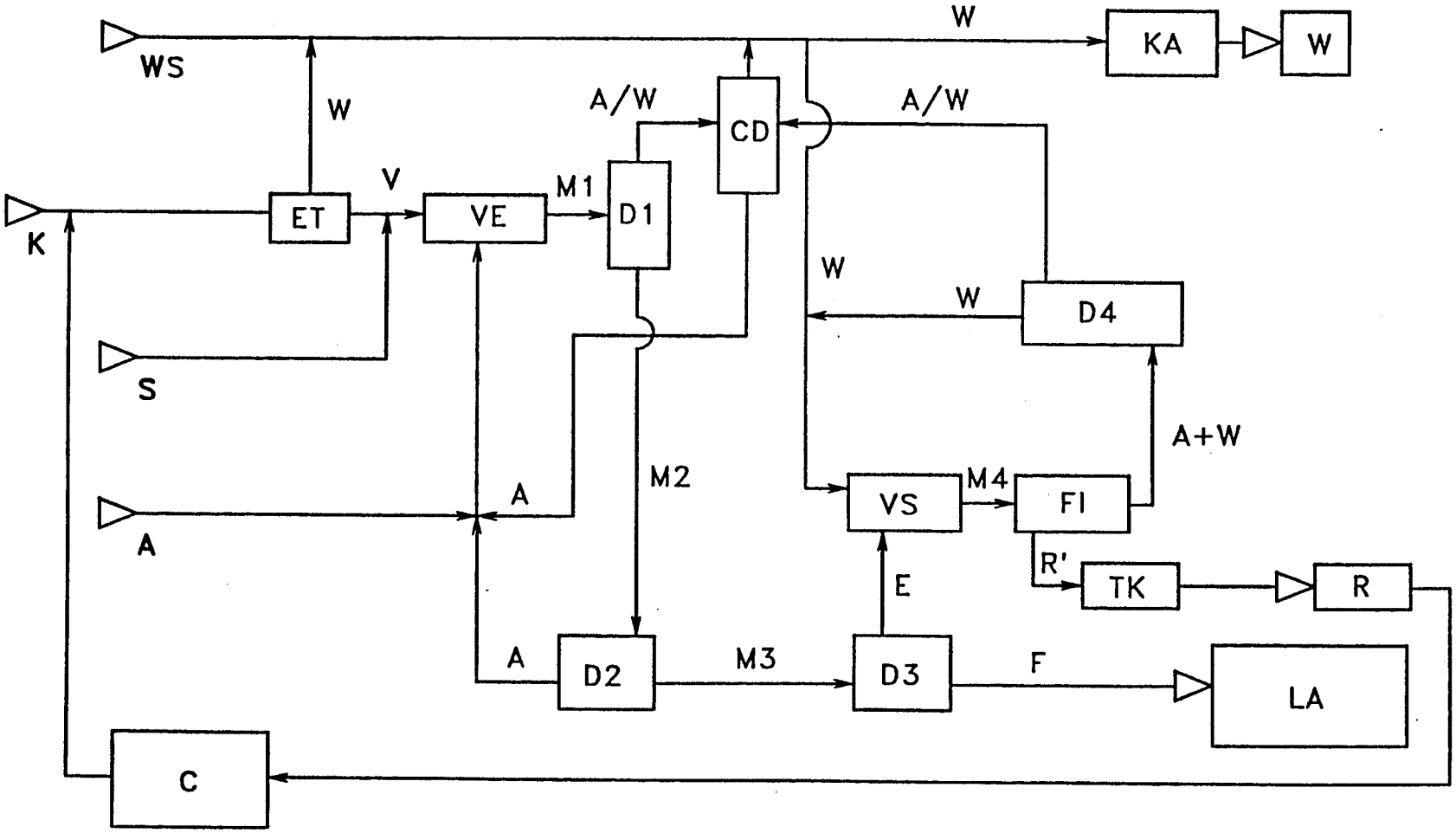
FIG. 2 is an additional schematic flowchart further depicting the treatment sequence according to the invention.

In other words, referring to FIG. 2, treatment of waste water from a nuclear reactor C or pre-concentrated waste water K begins in a first process stage ET in which the waste water K is vaporized or dried. The water recovered from stage ET is returned to water supply WS for reuse in other processing stages. Boric acids, borates, and residues from intermediate storage facilities or used materials S and concentrate V from stage ET, are reacted with a long-chain primary alcohol A in an esterification stage VE. The esterification stage VE yields a mixture M1 containing water W, alcohol A, boric acid ester E and various contaminants F. A first distillation stage D1 separates out the azeotropic mixture of alcohol and water A/W from mixture $M_1$ and leaves behind a second mixture M2. Mixture M2 is then further separated in a second distillation D2 in which excess alcohol A is removed. The excess alcohol A is recyclable for re-use in other treatment stages. Removal of alcohol A leaves behind a mixture M3 containing boric acid ester E and contaminants F. A third distillation D3 separates the boric acid ester E from the contaminants F. The contaminants F can then be stored in long term storage area LA. The boric acid ester E is then reacted with water W in a saponification stage VS yielding a mixture M4 containing boric acid R', alcohol A and water W. The wet boric acid R' is filtered out at separation stage FI and is then dried in drying stage TK to yield substantially pure boric acid R which can then also be recycled for use in treating additional primary cooling water in nuclear reactor C. The alcohol A and water W mixture from stage FI can be distilled at stage D4 to remove the azeotropic mixture of alcohol and water A/W, leaving behind water W which can be returned to the water supply WS. The azeotropic mixtures of alcohol and water A/W from the two distillation stages D1 and D4 can be separated at stage CD by condensing and decanting. Once separated, the alcohol and water can then each be recycled back into the treatment process. The pure process water W, after being checked in a control analysis KA, can also be released for general disposal. Any residual water formed during the process and which may still contain boron can be returned to the process for further processing.

The invention is explained in greater detail below with reference to two embodiments:

EXAMPLE 1

Pre-concentrated waste water originating from a nuclear power plant has a boric acid content of 10 wt. % and a specific gamma activity of 0.5 Ci/t, the greatest part of which is due to antimony and to the radioactive nuclides cobalt and manganese. The waste water is then further concentrated in an evaporator until almost dry, resulting in a concentrated slurry. N-butanol is added to the slurry concentrate in multiple excess in an esterification device, that is, the alcohol is preferably added in a quantity of at least about twice that of the boric acid. The reaction is continued with reflux for at least two hours to achieve a complete conversion of boric acid and n-butanol to boric acid ester. Then the remaining water, the reaction water produced and the excess butyl alcohol are distilled off as an azeotropic mixture. A residue of insoluble salts and boric acid tributyl ester remains in the distillant. After the azeotropic mixture is distilled off, the tributyl ester is expelled at an absolute pressure of 800 hPa, or alternately 800 kPa.

The remaining residue is now practically free of boric acid, and can be transported directly into appropriate final storage containers. The volume to be disposed of can be reduced to approximately 1% of the original concentrate mass by means of the process according to the invention.

The distilled azeotropic mixture of butanol and water is then first condensed and subsequently decomposed in a decanter into the two phases butanol and water. The water can be used for the saponification of the boric acid ester, while the butanol is available for repeated esterification.

The boric acid ester is hydrolized with water, and the crystalline boric acid thereby precipitated is separated from the rest of the water by means of a separator, and the boric acid is transferable outward from the process, to be used for treatment of the primary cooling water of the pressurized water reactor. The remaining excess water can be recycled and the alcohol obtained during the saponification can also be separated and recycled for the further esterification of concentrates.

In an alternative embodiment of the above example the boiling point of the azeotropic mixture of butanol and water could be a value greater than or less than the stated temperature of 93° C. Boiling temperatures vary due to variations in the pressure applied during the distillation and the constituents in the mixture which is being distilled. A reduction of pressure applied to distillations will lower boiling temperatures and an increase in pressure or an addition , for example, of a soluble substance may raise boiling temperatures.

Similarly, the boiling temperature of the pure alcohol could be greater than or less than the stated 117.5° C. and the boiling temperature of the butyl ester may be greater than or less than the stated 227° C. The boiling temperatures will also vary with the alcohol used to carry out the esterification. For example, according to the CRC Handbook of Chemistry and Physics, 63rd Edition, at least at pages C-329, C-419 and D-12, at one atmosphere of pressure the boiling temperature of n-pentanol is 137.3° C., boiling temperature of n-hexanol is 158° C. and the boiling temperature of the azeotropic mixture of n-hexanol and water is 97.8° C.

In an alternative embodiment of the above example, the concentration of boric acid in the concentrate may be at different values which may possibly include 1%, 2%, 3%, 4%, 5%, 6%, 7%, 8%, 9%, 10%, 11%, 12%, 13%, 14%, 15% and ranges thereinbetween.

In an alternative embodiment of the above example, the specific gamma activity of the radioactive nuclides may be at different values which may include 0.1, 0.2, 0.3, 0.4, 0.5, 0.6, 0.7, 0.8, 0.9, 1.0 Ci/t and ranges thereinbetween.

EXAMPLE 2

A special pre-vaporizer is operated in a nuclear power plant with caustic soda. The boron is present in the concentrate as sodium borate. To use the process according to the invention, the evaporator concentrate needs to first be neutralized with hydrochloric acid. The process then continues as described in Example 1. In this case, however, the neutralization precipitates a rather large amount of sodium chlorite, which can be disposed of separately or together with the contaminated ingredients of the residues. In such cases where alkaline concentrate is used as the initial compound, experience shows that the residue totals approximately 10% of the original amount of concentrate.

In summary, one feature of the invention resides broadly in a process for the treatment of waste water containing boron compounds and radionuclides. The waste water is essentially vaporized until dry to yield a concentrate. Boric acid ester is produced in a reaction by the addition of a long chain primary alcohol to the concentrate. The boric acid ester and the non-radioactive components are then separated from the concentrate leaving behind a radioactive residue.

Another feature of the invention resides broadly in a process characterized by the fact that the azeotropic mixture formed from the esterification is separated from the concentrate by distilling. The azeotropic mixture is then further separated into alcohol and water by condensing and decanting, and the alcohol and water are recycled back into the process.

A further feature of the invention resides broadly in a process characterized by the fact that the boric acid ester is separated from the concentrate by distilling. The boric acid ester is then saponified back into boric acid and alcohol. The alcohol obtained in this manner is recycled for esterification of additional concentrate, and the boric acid obtained is used for further treatment of additional water.

A yet further feature of the invention resides broadly in a process characterized by the fact that any remaining non-radioactive components are removed from the residue before the disposal of the residue.

Yet another feature of the invention resides broadly in a process characterized by the fact that n-butanol is used as the long-chain alcohol.

An additional feature of the invention resides broadly in a process characterized by the fact that the distillations take place at pressures below atmospheric pressure.

A yet additional feature of the invention resides broadly in a process characterized by the fact that alkaline concentrates are neutralized before the treatment process.

A yet further feature of the invention resides broadly in a process characterized by the fact that the alcohol used can be an alcohol from the group consisting of: n-butanol, n-pentanol and n-hexanol.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. Process for the treatment of waste water containing boric acid, at least one borate, and radionuclides, said process comprising the steps of:

concentrating said waste water containing boric acid, at least one borate, and radionuclides to form a concentrate;

esterifying said boric acid and said at least one borate;

during said esterification step, maintaining said concentrate at a temperature below the boiling temperature of an azeotropic mixture of water and an alcohol, said alcohol having a straight chain of at least four carbon atoms;

during said esterification step, mixing said alcohol with said concentrate to form a mixture, said mixture comprising:

water and said alcohol;

a boric acid ester; and a residue containing non-radioactive components and radioactive contaminants;

separating at least a portion of said boric acid ester from said mixture; and separating at least a portion of said non-radioactive components from said residue.

2. A process for the treatment of waste water according to claim 1, wherein said concentrating of said waste water comprises vaporizing said waste water.

3. A process for the treatment of waste water according to claim 2, wherein said vaporizing of said waste water is done in an evaporator until said concentrate comprises a slurry, said slurry being almost dry.

4. A process for the treatment of waste water according to claim 1, wherein said alcohol having a straight chain of at least four carbon atoms is a primary alcohol.

5. A process for the treatment of waste water according to claim 4, wherein said mixing of said alcohol into said concentrate includes the addition of an excess quantity of said alcohol of at least about two times that of said boric acid content in said concentrate.

6. A process for the treatment of waste water according to claim 5, further including distilling said azeotropic mixture of water and said alcohol;

separating said alcohol from said water by condensing and decanting said azeotropic mixture; and recycling said alcohol back into said esterification step in said process for the treatment of waste water.

7. A process for the treatment of waste water according to claim 6, further including a second distilling of said mixture, said second distilling being a distillation of said excess quantity of said alcohol; and recycling said excess quantity of said alcohol back into said esterification step in said process for the treatment of radioactive waste water.

8. A process for the treatment of waste water according to claim 7, further including:

breaking down said boric acid ester into a reformed boric acid and are formed alcohol and subsequently separating said reformed boric acid from said reformed alcohol; and recycling said reformed boric acid into a nuclear reactor and recycling said reformed alcohol back into said esterification step in said process for the treatment of waste water.

9. A process for the treatment of waste water according to claim 8, wherein said breaking down comprises saponification by an addition of water.

10. A process for the treatment of waste water according to claim 9, further including disposing said residue into a long term storage facility.

11. A process for the treatment of waste water according to claim 1, further including neutralizing said concentrate before said concentrate is mixed with said alcohol when said concentrate is alkaline.

12. A process for the treatment of waste water according to claim 8, further including reducing said boiling temperatures of said distillations by performing said distillations at pressures below atmospheric pressure.

13. A process for the treatment of waste water according to claim 8, wherein said primary alcohol having a straight chain of at least four carbon atoms is a straight chain alcohol and wherein said straight chain alcohol is selected from the group consisting of: n-butanol, n-pentanol and n-hexanol.

14. A process for the treatment of waste water according to claim 6, further including a drying step of said mixture subsequent to the first distillation, said drying step removing said boric acid ester from said mixture, leaving behind a solid waste.

15. A process for the treatment of waste water according to claim 14, further including:

breaking down said boric acid ester back into a reformed boric acid and a reformed alcohol and subsequently separating said reformed boric acid from said reformed alcohol; and recycling said reformed boric acid into a nuclear reactor and recycling said reformed alcohol back into said esterification step in said process for the treatment of waste water.

16. A process for the treatment of waste water according to claim 15, wherein said breaking down comprises saponification by an addition of water.

17. A process for the treatment of waste water according to claim 7, wherein said separating said boric acid ester comprises a third distilling of said mixture subsequent to said second distilling;

breaking down said boric acid ester into a reformed boric acid and a reformed alcohol and subsequently separating said reformed boric acid from said reformed alcohol; and recycling said reformed boric acid into a nuclear reactor and recycling said reformed alcohol back into said esterification step in said process for the treatment of waste water.

18. A process for the treatment of waste water according to claim 17, wherein said breaking down comprises saponification by an addition of water.

19. A process for the treatment of waste water according to claim 5, further including distilling said azeotropic mixture of water and said alcohol;

separating said alcohol from said water by distilling said azeotropic mixture; and recycling said alcohol back into said esterification step in said process for the treatment of waste water.

* * * * *

UNITED STATES PATENT AND TRADEMARK OFFICE

CERTIFICATE OF CORRECTION

PATENT NO. : 5,096,624

DATED : March 17, 1992

INVENTOR(S) : Aloys, DORR, Uwe KÄLBERER, Klaus ROSE

It is certified that error appears in the above-identified patent and that said Letters Patent is hereby corrected as shown below:

On the title page, under the Foreign Application Priority Data section, item 30, insert the following:

--December 13, 1989 PCT Appln. No. PCT/DE89/00775.--

In column 1, line 6, please insert the following paragraph:

--CROSS-REFERENCE TO RELATED APPLICATION

This application is a continuation-in-part of International Application No. PCT/DE89/00775 filed on December 13, 1989, designating the United States of America which, in turn, claims priority from Federal Republic of Germany Patent Application No. P 38 42 655.2 filed on December 14, 1988.--

In column 4, line 17, after 'mixture', delete "$M_1$" and insert --M1--.

UNITED STATES PATENT AND TRADEMARK OFFICE

CERTIFICATE OF CORRECTION

PATENT NO. : 5,096,624

DATED : March 17, 1992

INVENTOR(S) : Aloys Dorr, et al.

It is certified that error appears in the above-indentified patent and that said Letters Patent is hereby corrected as shown below:

Column 7, claim 8, line 56, after (1st. occ.) of "and" delete "are formed" and insert --a reformed--.

Signed and Sealed this

Thirtieth Day of November, 1993

*Attest:*

*Attesting Officer*

Bruce Lehman

BRUCE LEHMAN

*Commissioner of Patents and Trademarks*